United States Patent [19]

Karlovich

[11] Patent Number: 5,037,328

[45] Date of Patent: Aug. 6, 1991

[54] FOLDABLE DIELECTRIC INSERT FOR A COAXIAL CONTACT

[75] Inventor: Robert J. Karlovich, Mechanicsburg, Pa.

[73] Assignee: AMP Incorporated, Harrisburg, Pa.

[21] Appl. No.: 531,192

[22] Filed: May 31, 1990

[51] Int. Cl.[5] ..... H01R 13/00

[52] U.S. Cl. ..... 439/578

[58] Field of Search ..... 439/578–585

[56] References Cited

U.S. PATENT DOCUMENTS

| | | | |
|---|---|---|---|
| 3,699,504 | 10/1972 | Huber | 339/177 R |
| 4,010,538 | 3/1977 | O'Keefe et al. | 29/630 A |
| 4,129,352 | 12/1978 | Iizuka | 339/177 R |
| 4,624,525 | 11/1986 | Ichimura et al. | 439/585 |
| 4,859,197 | 8/1989 | Toramoto et al. | 439/675 |

*Primary Examiner*—Joseph H. McGlynn

[57] ABSTRACT

A coaxial contact (22) for termination to a coaxial cable (200) having a center conductor (208) surrounded by a dielectric material (206) thence a braid (204) and jacket. The coaxial contact (22) has a center contact (24) with a mating portion (42), a conductor attaching portion (46) and a shank (50) extending therebetween. A first substantially semi-cylindrical insert member (160) having an axial recess (170) adapted to receive at least a portion of the center contact (24) is positioned adjacent the center contact (24), A second substantially semi-cylindrical dielectric insert member(162) is adapted to be positioned over the first insert member (160) resulting in a substantially cylindrical dielectric structure (26) that surrounds a portion of the center contact (24). A ferrule (28, 28') is positioned over a portion of the dielectric insert. An electrically conductive shell secures the subassembly together. The shell has a forward cylindrical contact portion (76) and a cable attaching, braid engaging portion (80).

20 Claims, 8 Drawing Sheets

FOLDABLE DIELECTRIC INSERT FOR A COAXIAL CONTACT

BACKGROUND OF THE INVENTION

This invention relates to disposing a center contact in a coaxial contact, and in particular to a two-piece dielectric insert for positioning a center contact in a coaxial contact and for insulating the center contact from the surrounding conductive shell.

Dielectric inserts used to position a center contact in a coaxial contact have typically been annular in structure, taking the shape of a cylinder with a bore through the center. The center coaxial contact is passed partially through the bore and secured. A necessary result is that the diameter of the bore must be large enough to accommodate the largest cross section of the contact portion passed into or through the bore.

There is disclosed in U.S. Pat. No. 3,699,504 an open barrel coaxial cable terminal including a sleeve formed from a dielectric material having resilient buttons for insertion into and snap-in retention in a sleeve portion. The sleeve portion of the terminal is freely insertable within the inner diameter portion of the dielectric sleeve.

It would be desirable to have a dielectric insert to position a center coaxial contact that does not require passing the center contact through a central bore and would provide for a passage through the insert commensurate with the varying cross section of the contact to be received therein. Such an insert would more accurately align and hold the contact in a desired position.

SUMMARY OF THE INVENTION

In accordance with the present invention, a coaxial contact for termination to a coaxial cable having a center conductor surrounded by a dielectric material thence a braid and jacket. The coaxial contact has a center contact with a mating portion, a conductor attaching portion and a shank extending therebetween. A first substantially semi-cylindrical insert member having an axial recess adapted to receive at least a portion of the center contact is positioned adjacent the center contact. A second substantially semi-cylindrical dielectric insert member is adapted to be positioned over the first insert member resulting in a substantially cylindrical dielectric structure that surrounds a portion of the center contact. An electrically conductive shell receives the cylindrical structure and secures the subassembly together. The shell has a forward cylindrical contact portion and a cable attaching, braid engaging portion.

DESCRIPTION OF THE PREFERRED EMBODIMENT

Figure 1:
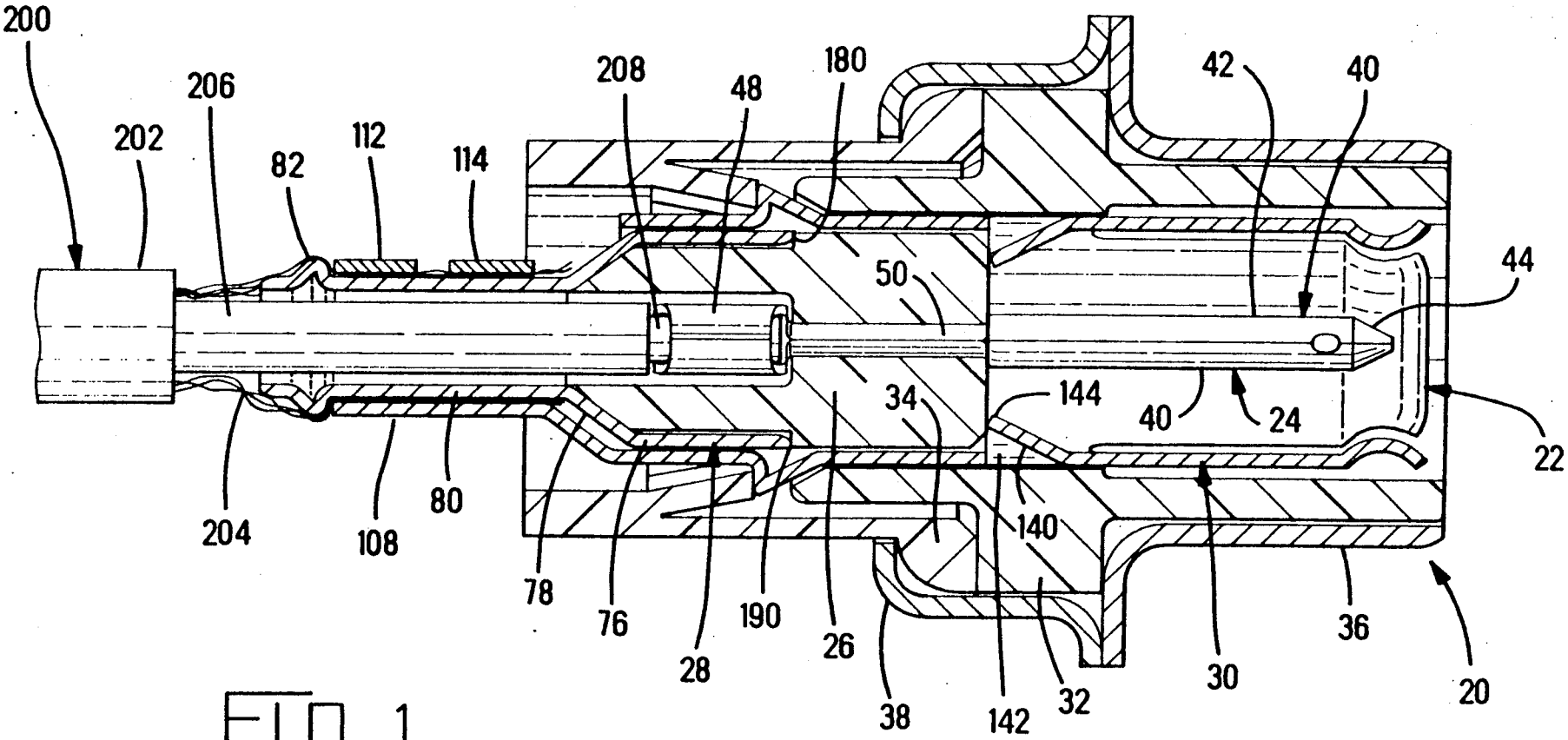
FIG. 1 is a partial cross section through a receptacle connector showing a coax center contact secured in a receptacle coaxial contact by a two-piece dielectric insert, in accordance with the present invention.

A connector 20 is shown in FIG. 1 including a receptacle coaxial contact 22 having a center contact 24 secured therein by a two-piece dielectric insert 26 in accordance with the present invention. Coaxial contact 22 also includes a ferrule 28 and receptacle shell 30. Connector 20 includes front and rear dielectric housing members 32,34 and, if shielded, includes front and rear shell means 36,38. Coaxial contact 22 may be used in conjunction with connector 20 or alone. When used in conjunction with connector 20, contact 22 may be secured in connector 20 in accordance with the teaching of concurrently filed U.S. patent application No. 07/531,212, now U.S. Pat. No. 4,990,104, entitled "Snap-In Retention System For Coaxial Contact," the disclosure of which is hereby incorporated by reference, or any other known method.

Figure 4:
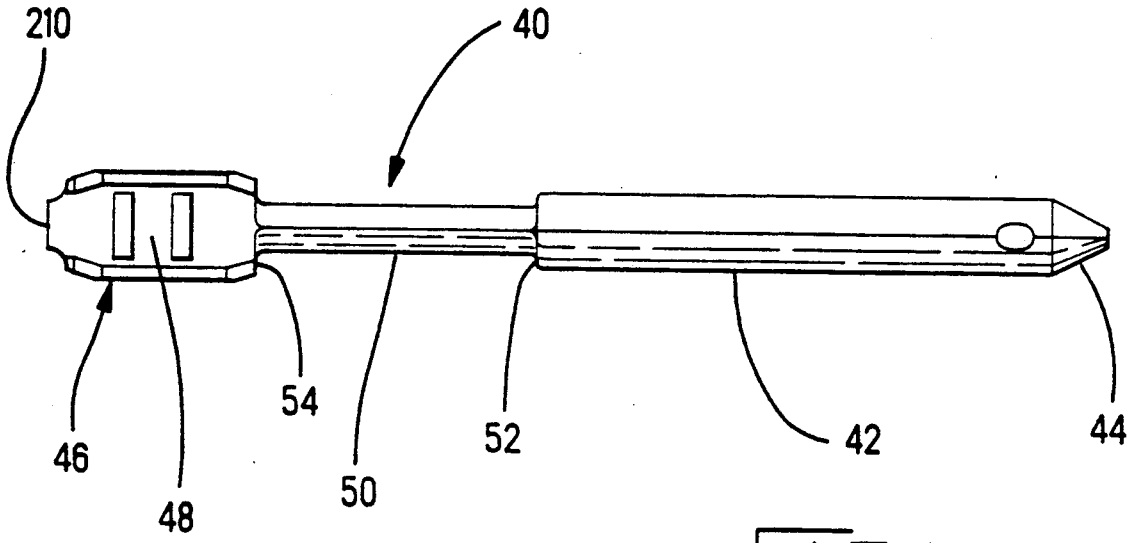
FIG. 4 is a pin center contact.

Center contact 24 shown in FIG. 1 is a pin contact 40. A top view of an unterminated pin contact 40 is shown in FIG. 4. Pin contact 40 is typically stamped and formed from electrically conductive material such as brass stock and has a mating portion 42 with tapered end 44 to facilitate mating, a terminating portion 46 in the form of crimp barrel 48 and a reduced diameter shank 50 between the mating and terminating portions. The difference in diameter between shank 50 and mating portion 42 defines rearwardly facing annular shoulder 52. The difference in diameter between shank 50 and barrel 46, when crimped, defines forwardly facing shoulder 54. Shank 50 thus extends between shoulders 52 and 54.

Figure 2:
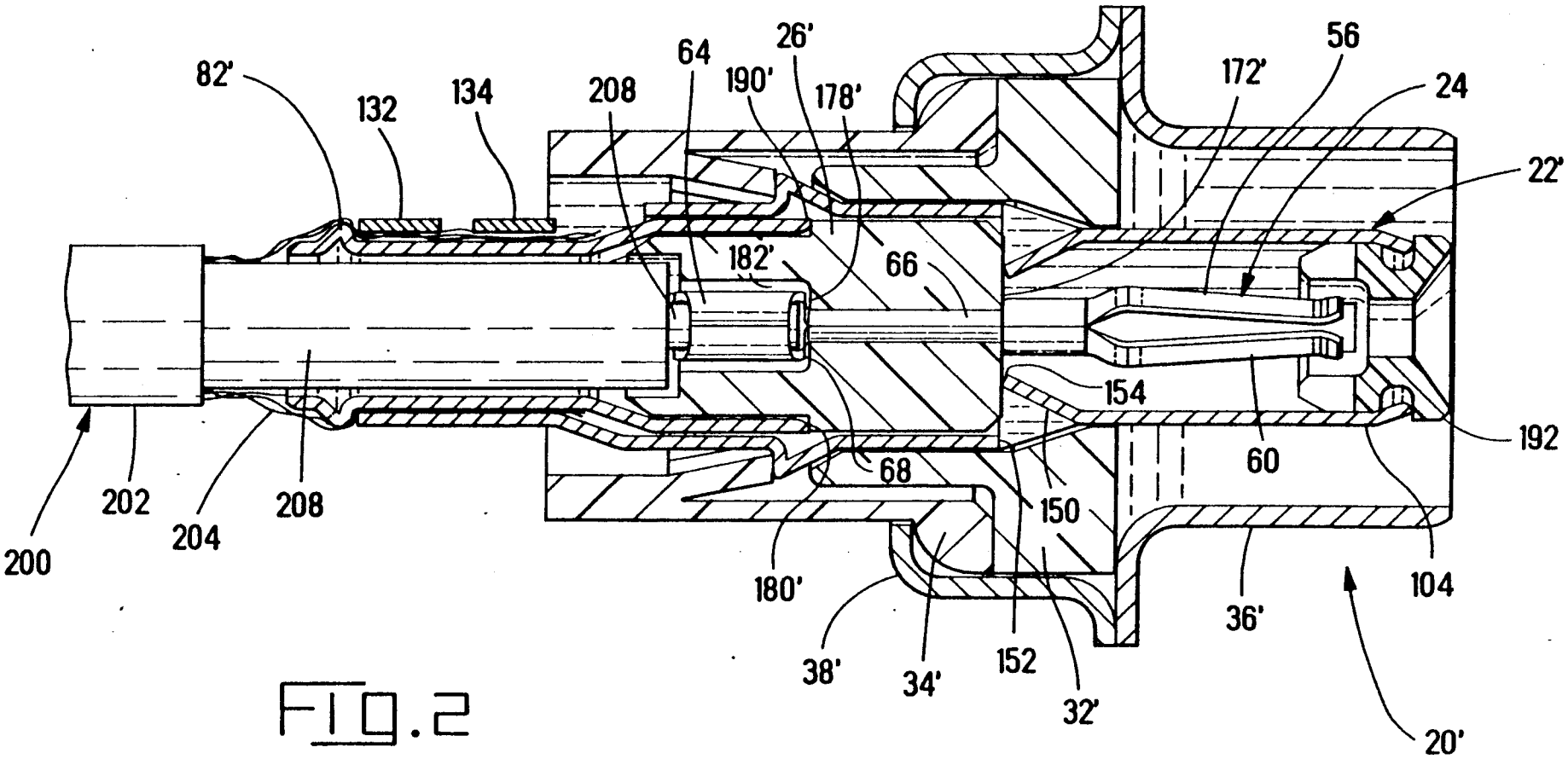
FIG. 2 is a partial cross section through a plug connector showing a coax center contact secured in a plug coaxial contact by a two-piece dielectric insert.
Figure 5:
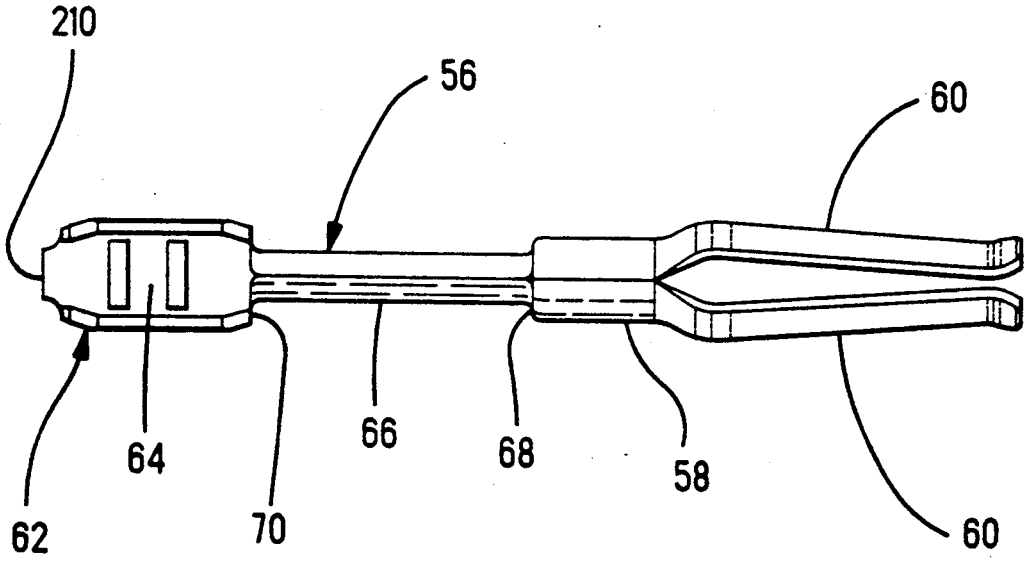
FIG. 5 is a receptacle center contact.

A plug coaxial contact 22' secured in connector 20' is shown in FIG. 2. Connector 20' includes front and rear dielectric housing members 32',34' and if shielded includes front and rear shell means 36' and 38'. The center contact 24 is shown as a receptacle contact 56. A top view of an unterminated receptacle contact 56 is shown in FIG. 5. Contact 56 is also typically stamped and formed from phosphor bronze stock and has a cylindrical barrel 58 formed with cantilever beams 60 extending therefrom for receiving therebetween mating portion 42 of a pin contact, a terminating portion 62 in the form of a crimped barrel 64, and a reduced diameter shank 66 between the cylindrical barrel and crimp barrel. The differential diameter between shank 66 and cylindrical barrel 58 defines a rearwardly facing annular shoulder 68. The difference in diameter between shank 66 and barrel 64, when crimped, defines forwardly facing shoulder 70. Thus, shank 66 extends between shoulders 68 and 70.

Figure 6A:
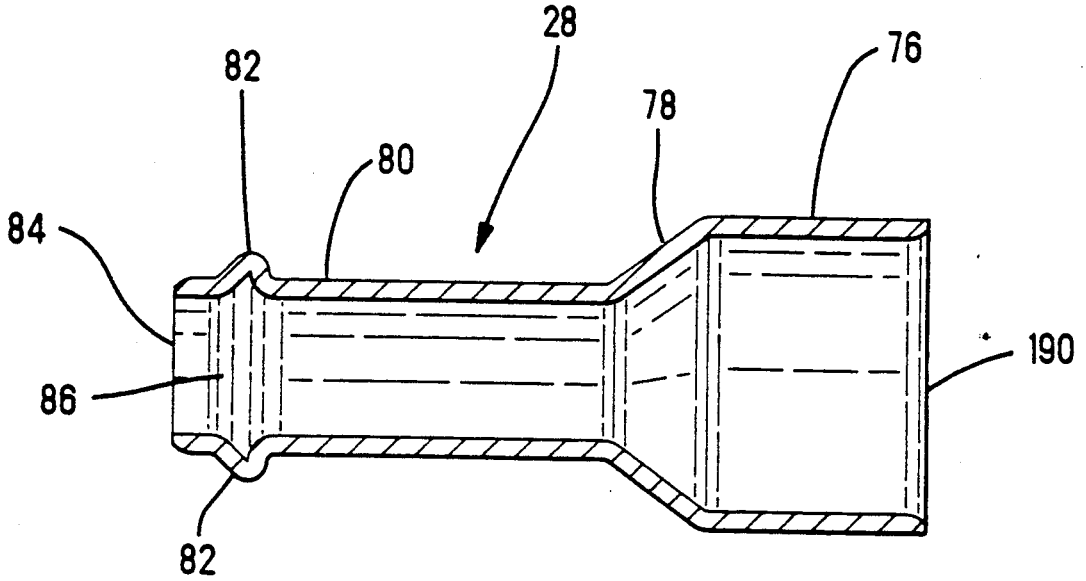
FIG. 6A is a ferrule for use with the insert of FIG. 3A.
Figure 6B:
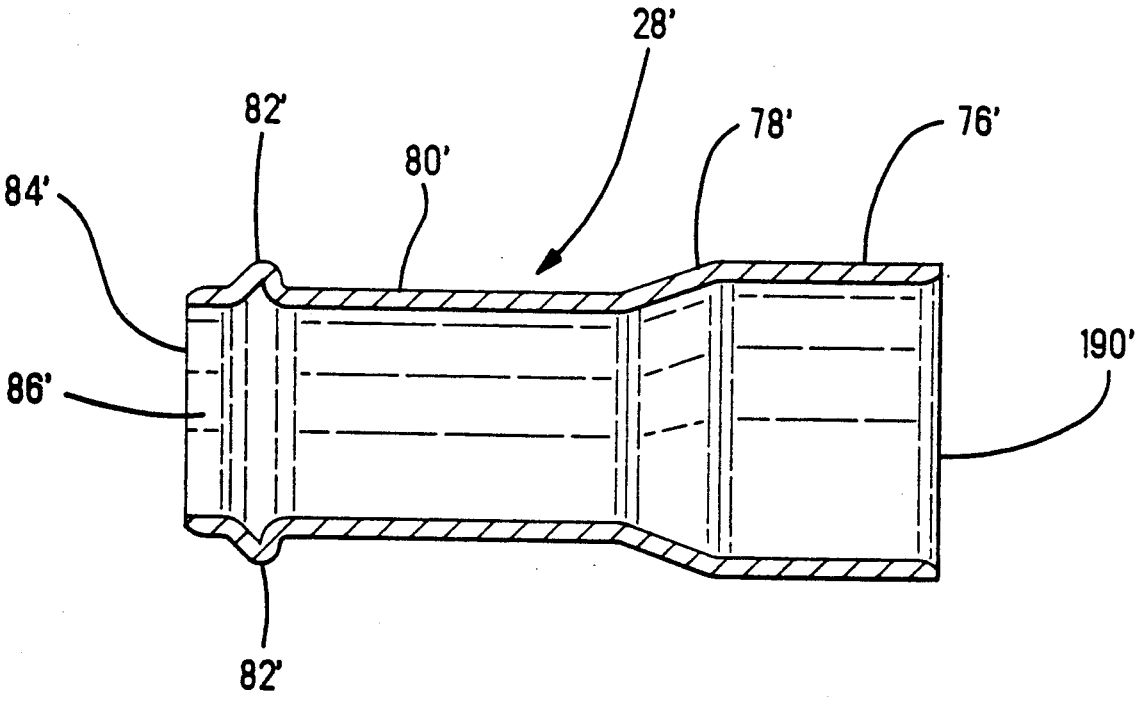
FIG. 6B is a ferrule for use with the insert of FIG. 3B.

A drawn conductive ferrule 28, is shown in cross section in FIG. 6A for a small diameter cable and a ferrule 28' is shown in cross section in FIG. 6B for a large diameter cable. While the ferrule in the preferred embodiment is a drawn member, such a ferrule could also be stamped and formed. Ferrules 28 and 28' are electrically conductive and typically manufactured from a copper alloy. Each ferrule has a large diameter forward end 76,76', a tapered section 78,78' and a reduced diameter cylindrical rear section 80,80'. Each cylindrical section has an annular ridge 82,82' of larger diameter than the respective reduced diameter cylindrical rear section proximate the free edge 84,84', with free edge 84,84' defining a cable entry 86,86'.

Figure 7:
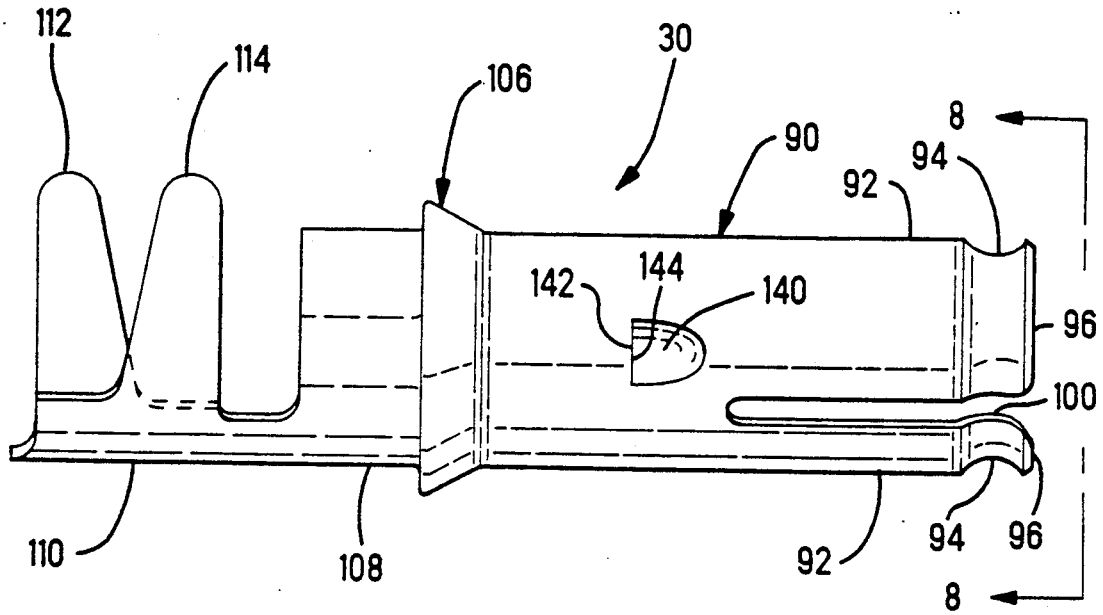
FIG. 7 is a side view of a receptacle shell.
Figure 8:
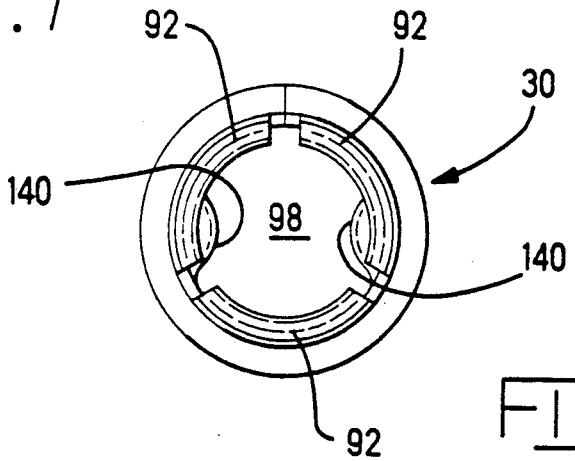
FIG. 8 is a front view of the receptacle shell of FIG. 7.

The side view of a receptacle shell 30 is shown in FIG. 7. In the preferred embodiment, shell 30 is stamped and formed from phasphor bronze strip stock. Receptacle shell 30 has a hollow generally cylindrical shape having a slotted forward end 90 forming cantilever beams 92. Each beam 92 has an arcuate recess 94 proximate distal end 96, collectively forming a reduced diameter plug receiving opening 98 best seen in FIG. 8. Typically, plug shell 30 is manufactured of stock that has been strip gold plated such that the plating is on inner arcuate surfaces 100. The inner surface 100 of recesses 94 engage and wipe the exterior surface 102 of a plug shell 104 shown in FIG. 9 as plug and receptacle contacts are mated or unmated. Inner surfaces 100 provide redundant points of electrical and mechanical contact with the exterior surface of a mated plug shell. Forward end 90 extends rearward through a retention section 106, described in more detail in concurrently filed U.S. application Ser. No. 07/531,212, now U.S. Pat. No. 4,990,104 and a rear cylindrical ferrule receiving section 108. A portion of section 108 extends rearward forming extension 110 with crimp tabs 112 and 114 extending upwardly therefrom.

Receptacle shell 30 has forward stops 140 formed from a shear line segment 142 when stop 140 is formed inwardly relative to front end 90. Stops 140 provide arcuate stop shoulders 144 which assists in positioning insert 26 upon insertion into shell 30 and prevents over-insertion of insert 26.

Figure 9:
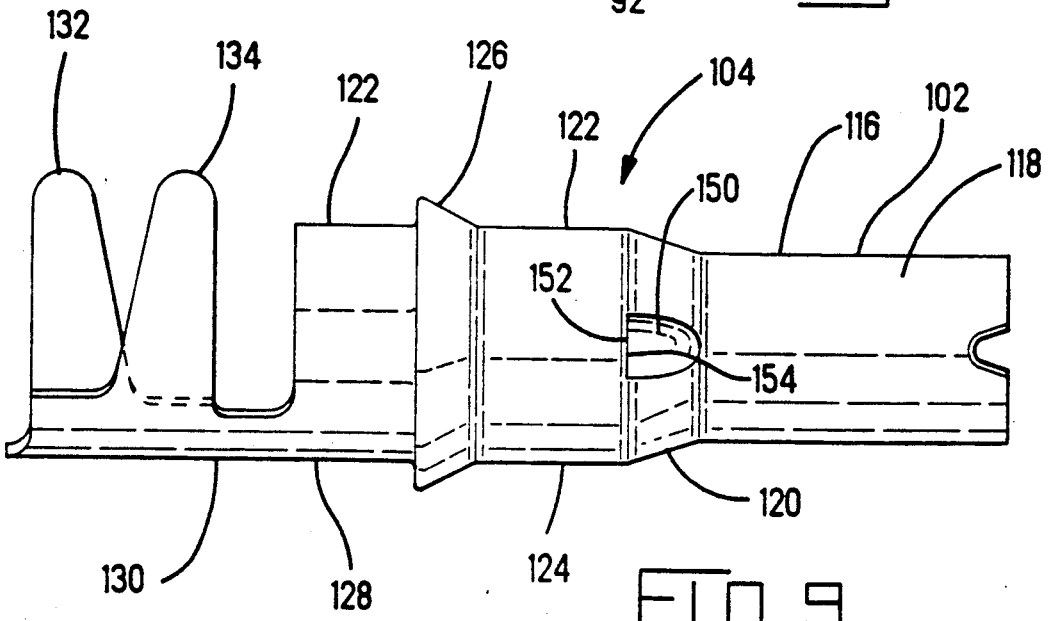
FIG. 9 is a side view of a plug shell.

A side view of a plug shell is shown in FIG. 9. Plug shell 104 has a hollow, generally cylindrical shape. Shell 104 is typically stamped and formed of brass. Shell 104 has a reduced diameter forward end 116 the outside surface 118 of which is typically gold plated. Forward end 116 is sized such that the outer diameter is receivable within opening 98 of forward end 90 of receptacle shell 30. Forward end 116 extends rearward to a transition region 120 of conical shape that tapers to a larger diameter section 122 that may have a retention section 126 therein. Section 122 includes ferrule receiving section 128 and insert receiving section 124 which have substantially the same inside diameter in the preferred embodiment and are substantially the same inside diameter as forward end 90 and ferrule receiving section 108 of receptacle shell 30. Ferrule receiving sections 108 and 128 have an inside diameter sized to receive the forward end 76 or 76' of ferrules 28 or 28' as best seen in FIGS. 1 and 2. A portion of ferrule receiving section 128 extends rearward forming extension 130 with crimp tabs 132 and 134 extending upwardly therefrom.

Plug shell 104 has stops 150 formed from a shear line segment 152. Stop 150 is formed inwardly relative to shell 104 resulting in an arcuate stop shoulder 154 which positions insert 26 upon insertion into shell 104 and prevents over-insertion of insert 26.

Figure 3A:
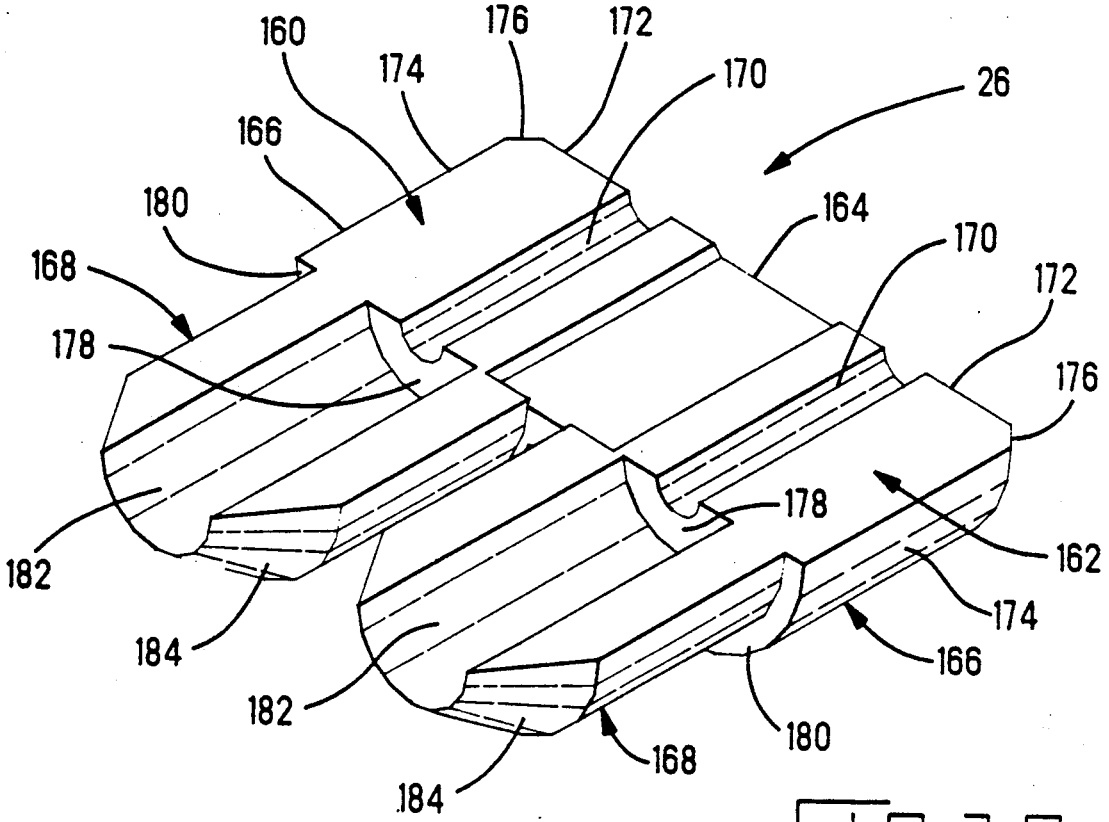
FIG. 3A shows a two-piece dielectric insert for a small diameter dielectric coaxial cable.
Figure 3B:
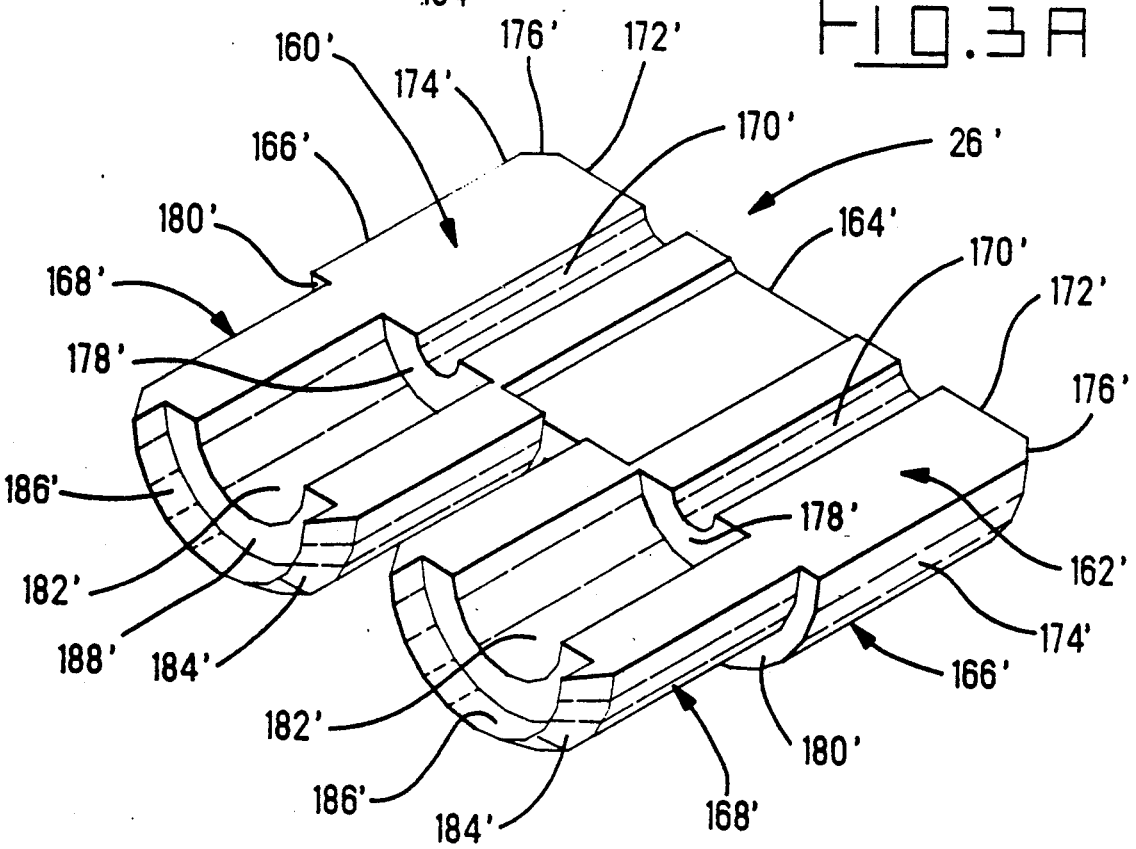
FIG. 3B shows a two-piece dielectric insert for a large diameter coaxial cable.

Two embodiments of a two-piece dielectric insert are shown in FIGS. 3A and 3B. The major difference between the two embodiments permits one of the inserts to accommodate a larger diameter coaxial cable. The FIG. 3A embodiment will be described; the same reference number having a prime notation will refer to similar structure in the embodiment of FIG. 3B.

A two-piece dielectric insert 26 is comprised of two substantially identical halves 160,162. Halves 160,162 in the preferred embodiment are molded of polyolefin and are hingedly interconnected by web 164. Each half has a forward portion 166 and a rearward portion 168. Each forward portion is substantially semi-cylindrical having a semi-cylindrical channel 170 coaxially disposed therein. Forward surface 172 is semi-annular in shape and engages a stop shoulder 144 or 154 upon insertion of insert 26 into shell 30 or 104 respectively. The edge of surface 172 along semi-cylindrical side wall 174 may be beveled 176 to facilitate entry of insert 26 into a shell. The rear of forward portion 166 is defined by inner semi-annular surface 178 concentrically disposed about channel 170 and outer semi-annular surface 180 also concentrically disposed about channel 170.

The spacing or distance between surfaces 172 and 178 is substantially the same spacing or distance between shoulders 52 and 54 of pin contact 40 (see FIG. 4), or the distance between shoulders 68 and 70 of receptacle contact 56 (see FIG. 5). The radius of semi-cylindrical channel 170 is substantially the same as or slightly smaller than the radius of shank 50 of a pin contact 40 or shank 66 of a receptacle contact 56. When halves 160 and 162 are positioned over each other in the absence of web 164 or when the two halves are folded about web 164, the two forward portions 166 form a cylindrical structure with the two semi-cylindrical channels 170 forming a centrally located cylindrical bore therethrough.

Rearward portion 168 extends from and is integral with forward portion 160 of each half 160,162 between inner semi-annular surface 178 and outer semi-annular surface 180. Rearward portion 160 is substantially semi-cylindrical having a semi-cylindrical channel 182 coaxially disposed therein and extending from semiannular surface 178 rearward. The radius of channel 182 is typically larger than the radius of channel 170 as channel 170 accommodates the shank of a center contact 24 while channel 182 accommodates the crimped barrel of a center contact 24. When halves 160 and 162 are folded about web 164 or positioned over each other in the absence of web 164, rearward portions 168 form a cylindrical structure with two semi-cylindrical channels 182 forming a centrally located cylindrical bore therethrough. Rearward portion 168 may be beveled 184 at the trailing edge to be received in a tapered portion of a ferrule 28 or 28'. To accommodate a larger diameter cable, a portion of channels 182 may be enlarged to form a larger diameter channel portion 186' to receive the dielectric of the cable being terminated to permit the insulative insert to overlap the coax cable dielectric. In a preferred embodiment, the distance from semi-annular surface 178,178' to semiannular surface 188' is substantially the length of the crimp barrel of a center contact between shoulder 54 or 70 and rear end 210.

The outside diameter of the rearward portion, when halves 160,162 are folded about web 164, is sized to be closely received within the forward end 76,76' of ferrule 28,28' with the leading edge 190,190' of ferrule 28,28' abutting semi-annular surfaces 180 in the assembled contact to position and secure insert 26 in the desired location within shell 30 or 104. Thus, arcuate stop shoulders 144 and 154 provide a forward stop for insert 26 or 26' while surfaces 180 or 180' provide a rear stop for the insert.

Each receptacle contact 22 thus comprises a center contact 24 in the form of pin contact 40, a two-piece dielectric insert 26 or 26', a shell 30 and a ferrule 28 or 28'. Each plug contact 22' comprises a center contact 24, in the form of receptacle contact 56, a two-piece dielectric insert 26 or 26', a shell 104 and a ferrule 28 or 28'. Plug contact 22' may include an insulated tapered lead-in insert 192 (in accordance with concurrently filed U.S. patent application Ser. No. 07/521,204, now U.S. Pat. No. 4,990,105, entitled "Tapered Lead-In Insert For A Coaxial Contact", the disclosure of which is hereby incorporated by reference). Other than insert 192, in the preferred embodiment, air is the only dielectric separating center contact 24 from shell 30 or 104 forward of surface 172 of insert 26.

Coaxial contacts 22 and 22' may be assembled and terminated to a coaxial cable manually or using automated assembly equipment. The assembly procedure will be described with reference to the sequence of FIGS. 10A-E.

Figure 10A:
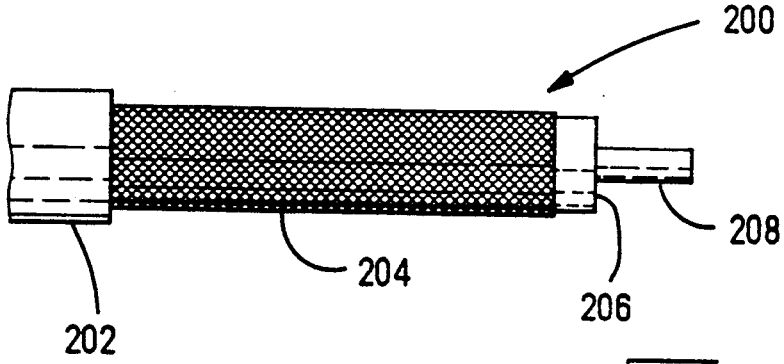
FIGS. 10A–F are a sequence of Figures showing the assembly of the insert to a center contact and ferrule.

FIG. 10A shows a coaxial cable 200 for terminating to a coaxial contact. The coaxial contact may be any of the contacts described herein. The jacket 202, braid 204 and dielectric 206 of the cable have been removed to expose a length of approximately 6.75 mm of the center conductor 208. Further, jacket 202 has been removed to expose a length of approximately 25 mm of the braid. The stripped center conductor 208 is laid into the open crimp barrel 48 or 64 of a center contact 24. Preferably, the cable dielectric 206 is butted against the rear end 210 of the crimp barrel. The center conductor is crimped in the crimp barrel thereby securing the center conductor to the coax center contact to complete a mechanical and electrical connection therebetween. The coax cable braid 204 is splayed and the terminated center contact 24 is passed into cable entry 86 or 86' and through a ferrule 28 or 28' appropriate for the diameter of cable 200. Alternatively, it may be stated that the ferrule is passed over the center contact.

Figure 10B:
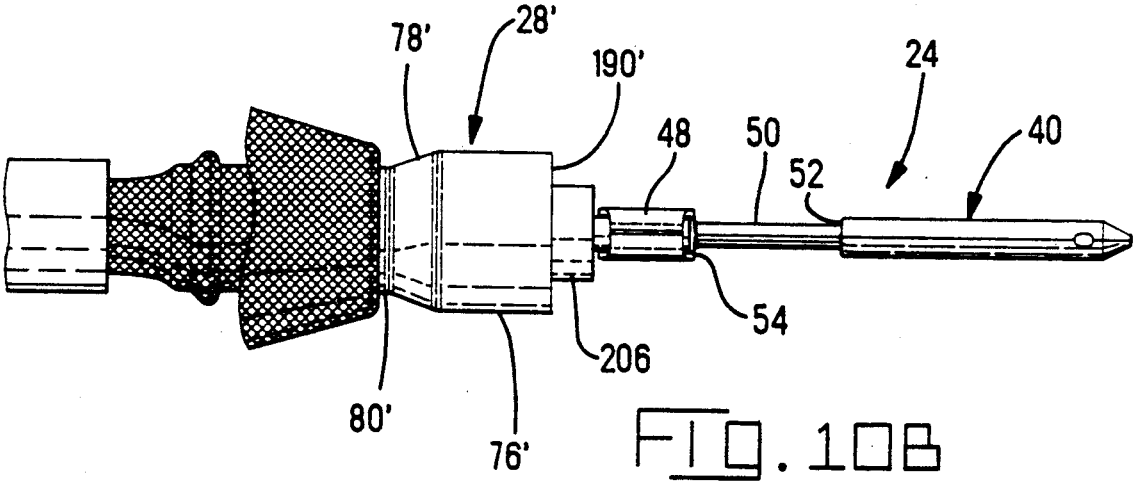

The ferrule is slid axially along the cable, with cylindrical section 80,80' between the cable dielectric 206 and the braid 204 to a position with the leading edge 190,190' beyond the crimp barrel of the center contact as shown in FIG. 10B.

Figure 10C:
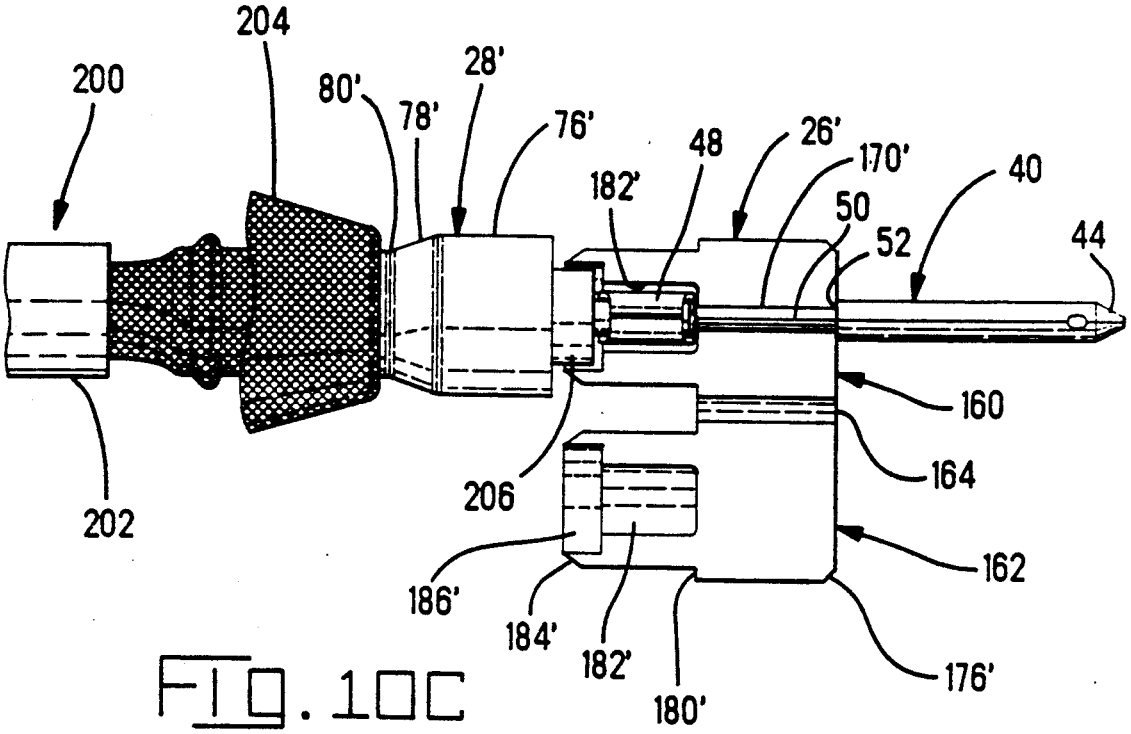

As shown in FIG. 10C, the center contact 24 is positioned in channels 170,182 or 170',182' of one half 160 or 162 With the crimp barrel being received in channel 182 and with shoulder 54,74 abutting semiannular surface 178 and with shank 50,66 received in channel 170, and shoulder 52,68 abutting forward surface 172. The other half 162 or 160 is positioned over the center contact, or if web 164 is present the other half is folded at web 164 around the center contact.

The forward end of the insert is held to maintain the center contact in position while the ferrule is slid axially along the cable toward the end of the mating contact such that rearward portions of the insert are received within forward end 76 of the ferrule until leading edge 190,190' engages outer semi-annular surfaces 180,180'. In this position, insert 26 is prevented from being removed inadvertently from contact 24. Insert 26 will not slide axially toward the unterminated end of center contact 24 due to the forward surfaces 172 engaging shoulders 52 or 68. In order to be removed, the two halves must be separated from each other to allow channels 170 to pass over shoulders 52 or 68. Thus, with insert 26 partially within ferrule 28,28', the center contact is held centered in insert 26 which is in turn centered within the ferrule.

Figure 10D:
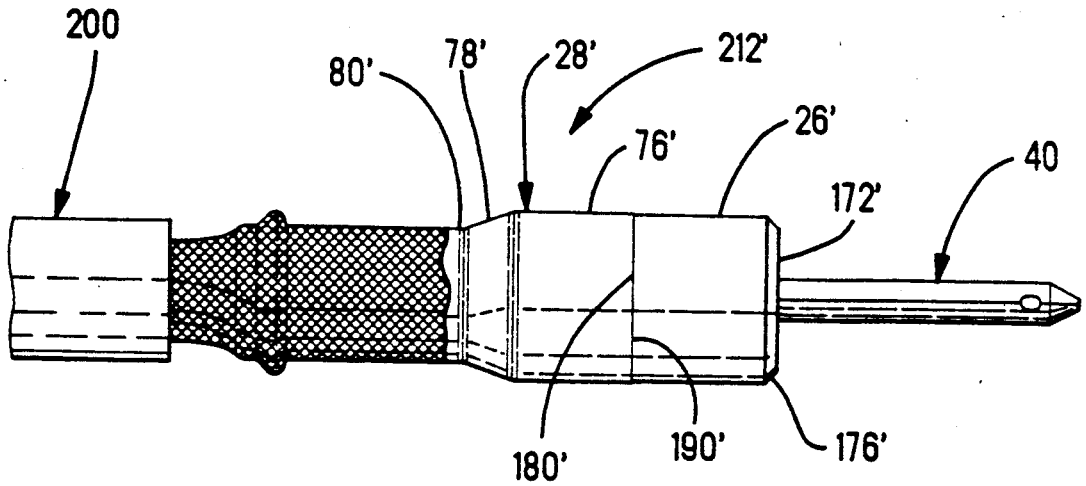

The cable braid 204 is then smoothed out to surround the smaller diameter cylindrical section 80,80' of the ferrule as shown in FIG. 10D.

Figure 10E:
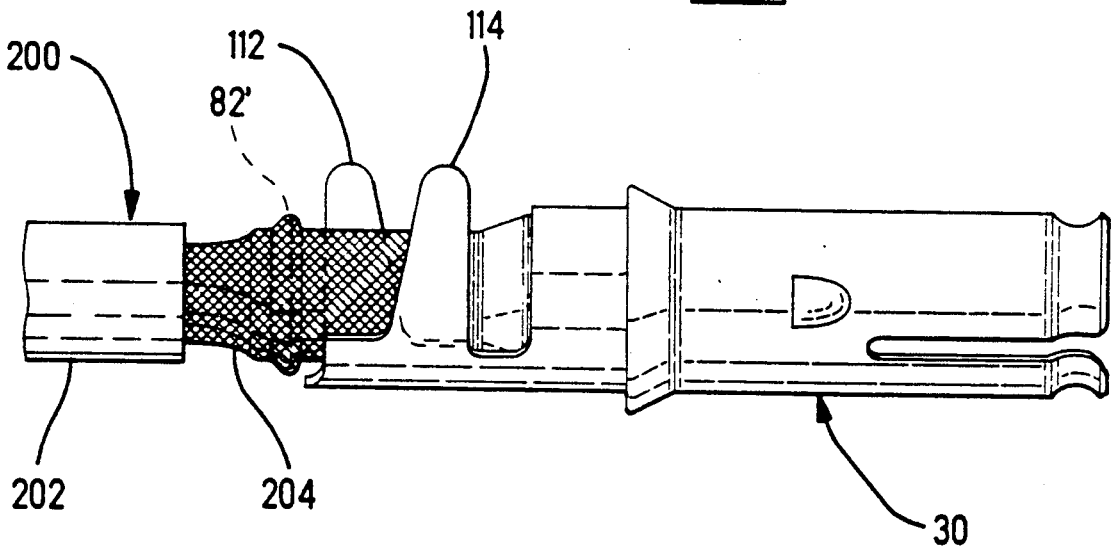

The above subassembly 212,212' is then inserted into the ferrule receiving end of a shell 30 or 104 until forward surface 172 or 172' engages forward stops 140,150, specifically the arcuate stop shoulders 144 or 154 as shown in FIG. 10E. This properly positions center contact 40, insert 26,26', ferrule 28,28' and subassembly 212,212' within shell 30,104 with center contact 24 coaxially centered in the shell.

Figure 10F:
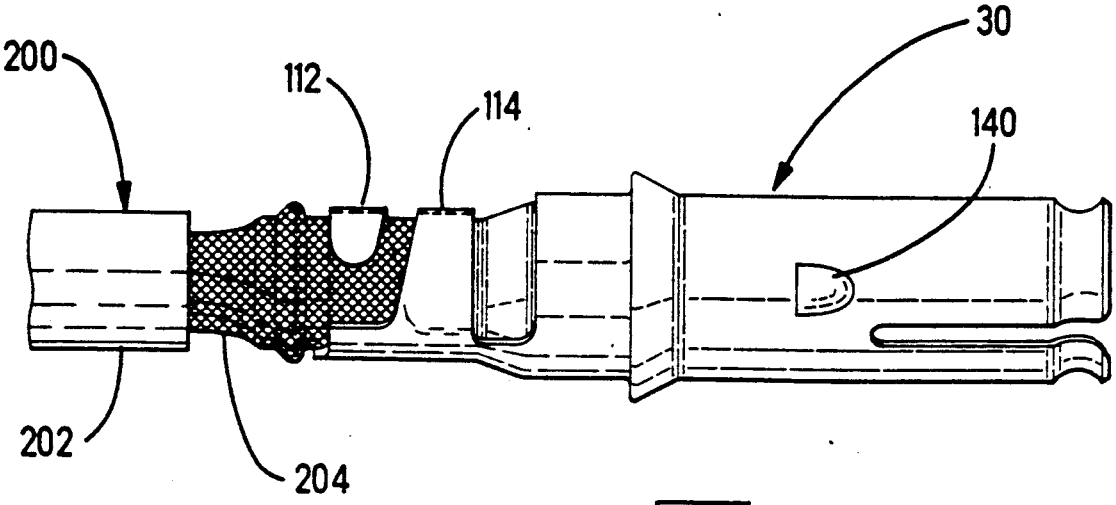

As shown in FIG. 10F, tabs 112,114 or 132,134 are then crimped over the braid to secure the shell to the subassembly and to complete an electrical path from shell 30,104 to braid 204. Crimping the tabs completes the assembly of the coax contact with the crimped tabs securing all parts of the connector together. The crimped tabs are between the annular ridge 82 and forward end 76 with the larger diameter of annular ridge 82 preventing the crimped tabs from otherwise sliding off cylindrical section 80,80'. The completed coaxial contact 22,22' may be inserted into dielectric housing means 34,36 if desired.

While the preferred embodiment has been described employing a crimp termination of the center conductor to the center contact and a crimp to secure the shell to the ferrule, other known means of termination such as soldering could be used. Various metal parts described in the preferred embodiment as stamped and formed members could be made in other ways such as being machined, or from other known materials suitable for the function each provides.

I claim:

1. A coaxial contact for termination to a coaxial cable having a center conductor surrounded by dielectric thence a braid and jacket, the coaxial contact comprising:

a center contact having a mating portion, a conductor attaching portion and a shank therebetween;

a first substantially semi-cylindrical dielectric insert member having an axial recess adapted to receive at least a portion of the center contact;

a second substantially semi-cylindrical dielectric insert member adapted to be positioned over the first insert member resulting in a substantially cylindrical dielectric structure that surrounds a portion of the center contact;

an electrically conductive shell for receiving the cylindrical structure, the shell having a forward cylindrical contact portion and a cable attaching braid engaging portion; and a ferrule, said ferrule having a forward portion sized to receive said inserts and in turn to be received within said shell, said ferrule encasing at least a portion of both insert members surrounding at least a portion of the center contact.

2. A coaxial contact as recited in claim 1, wherein the first and second insert members hingedly interconnected.

3. A coaxial contact as received in claim 1, wherein the shell further comprises a forward stop, said forward stop defining a rearwardly facing shoulder to engage a forward edge of one of said insert members, whereby when the insert member engages the shoulder the insert member is properly positioned.

4. A coaxial contact as recited in claim 1, wherein each insert member has a semi-annular rearwardly facing shoulder,. said shoulder enagageable by a leading edge of the ferrule, whereby the insert members are positioned between the leading edge of the ferrule and the forward stops.

5. A coaxial contact as recited in claim 1, wherein the shank of the center contact is smaller in diameter than the mating portion of the center contact.

6. A coaxial contact as recited in claim 1, wherein the first and second insert members have a channel to receive a portion of the center conductor.

7. A coaxial contact as recited in claim 6, wherein the channel in each insert member is semi-cylindrical.

8. A coaxial contact as recited in claim 7, wherein the shell has a forward stop, said forward stop defining a rearwardly facing shoulder to engage a forward edge of one of said insert members, and the channel of the insert members surrounding the shank of the center contact is smaller in diameter than the terminating portion of the center contact, whereby the force of unmating the coaxial contact from another contact is borne by the shell and the insert members and not by the center contact.

9. A coaxial contact as recited in claim 7, wherein the ferrule is secured to the shell, and wherein each insert member has a semi-annular rearwardly facing shoulder, said shoulder engageable by a leading edge of the ferrule, and the channel of the insert members surrounding the shank of the center contact is smaller in diameter than the mating portion of the center contact, whereby the force of mating the coaxial contact to another contact is borne by the shell, the insert members, and the ferrule, and not by the center contact.

10. A coaxial contact as recited in claim 7, wherein the channel in each insert member has a smaller diameter section to receive the shank of the center contact and a larger diameter section to receive a conductor terminating portion of the center contact.

11. A coaxial contact as recited in claim 10, wherein the channel in each insert member has another section adapted to receive a portion of the dielectric surrounding the center conductor.

12. A method of assembling a coaxial contact during termination of the coaxial contact to a coaxial cable having a center conductor surrounded by dielectric thence a braid and jacket, the method comprising the steps of:

securing the center conductor of the coaxial cable to a center coaxial contact;

passing the center contact through a ferrule;

positioning the center contact in an axial recess in a first substantially semi-cylindrical dielectric insert member;

positioning a second substantially semi-cylindrical dielectric insert member over the first semi-cylindrical dielectric insert member;

securing the first and second insert members to maintain the center contact positioned therebetween; and positioning the insert members and center contact within an outer shell.

13. A method of assembling a coaxial contact as recited in claim 12, wherein the step of positioning a second insert member over the first insert member comprises folding a second insert member along a web interconnecting the first and second insert members.

14. A method of assembling a coaxial contact as recited in claim 12, wherein the step of securing the first and second insert members comprises the step of moving the ferrule along the cable to position the first and second insert members at least partially within the ferrule.

15. A method of assembling a coaxial contact as recited in claim 14, further comprising the steps of positioning the braid of the coaxial cable over a portion of the ferrule and securing the shell and braid to the ferrule.

16. For use in terminating a contact to a coaxial cable, first and second dielectric insert members and a ferrule, wherein the first insert member has an axial recess adapted to receive at least a portion of the contact, the second insert member is adapted to be positioned over the first insert member resulting in a structure that surrounds a portion of the contact, the ferrule has a forward portion sized to receive the insert members, and the ferrule encases at least a portion of both insert members surrounding at least a portion of the contact.

17. An insert and a ferrule as recited in claim 16, wherein the two insert members hingedly interconnect.

18. An insert and a ferrule as recited in claim 16, wherein the ferrule is annular.

19. An insert and a ferrule as recited in claim 16, wherein the insert members are substantially semi-cylindrical, resulting in a substantially cylindrical structure when the second insert member is positioned over the first insert member.

20. An insert and a ferrule as recited in claim 19, wherein the second insert member has an axial recess, both axial recesses being semi-cylindrical.

* * * * *